United States Patent [19]

Graham

[11] 3,984,356

[45] Oct. 5, 1976

[54] LIQUID LAUNDERING DETERGENT AND SOFTENER

[75] Inventor: Lonzell Graham, Greenville, S.C.

[73] Assignee: Morton-Norwich Products, Inc., Greenville, S.C.

[22] Filed: Aug. 20, 1975

[21] Appl. No.: 606,243

[52] U.S. Cl. ..... 252/544; 252/8.6

[51] Int. Cl.[2] ..... C11D 1/04

[58] Field of Search ..... 252/8.6, 544; 260/413

[56] References Cited

UNITED STATES PATENTS

| | | | |
|---|---|---|---|
| 3,575,883 | 4/1971 | Foley | 252/544 |
| 3,753,968 | 8/1973 | Ward | 260/97.6 |
| 3,856,711 | 12/1974 | Mausner et al. | 252/544 |

*Primary Examiner*—Mayer Weinblatt
*Assistant Examiner*—Charles R. Wolfe, Jr.
*Attorney, Agent, or Firm*—Anthony J. Franze; Richard J. Egan

[57] ABSTRACT

There is provided a liquid detergent and softening composition for laundering purposes jointly combining high detergency and fabric softening properties.

1 Claim, No Drawings

LIQUID LAUNDERING DETERGENT AND SOFTENER

This invention is concerned with a composition for laundering purposes which combines high detergency and softening properties.

It is an object of this invention to provide a composition which will possess excellent soil removing properties during a laundering operation.

It is a further object of this invention to provide a composition containing a fabric softener to provide a feeling of softness to laundered materials subsequent to washing.

It is still a further object of this invention to provide a composition wherein the agents effecting cleansing and softening are mutually composed thus avoiding the separate steps of washing and softening.

Until now it has been the customary practice in laundering operations to effect cleaning of fabrics during a washing cycle using a variety of detergents of which presently detergents of the anionic type such as the alkali metal higher alkyl benzene sulfonates are the most effective and popular. To impart desirable softness to laundered fabrics, various softening agents such as the cationic quaternary ammonium compounds are added to the rinse cycle of laundering since the notorious incompatibility of cationic and anionic substances prohibits their joint use to elicit their desirable function.

In accordance with this invention and its aforestated objectives it has been discovered that excellent detergency and softening of fabrics can be concomitantly achieved in laundering through the use of a composition cnsisting of a detergent such as a linear primary alcohol ethoxylate such as a $C_{12}$-$C_{15}$ primary alcohol containing about nine ethylene oxide units per mole of which Neodol 25–9 (Shell Chemical Company) is typical; a dicarboxylic fatty acid of the formula:

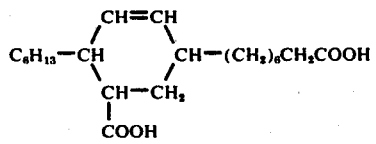

preferably in the form of its disodium salt; an alkanolamine such as diethanolamine; and water.

A preferred composition of this invention is illustrated thusly:

| Ingredient | Parts by Weight |
|---|---|
| Water | – 29 |
| Disodium salt of 8-(4-hexyl-5-carboxycyclohex-2,3-en-1-yl)octanoic acid | – 31 |
| Linear primary $C_{12}$–$C_{15}$ alcohol ethoxylate containing about nine ethylene oxide units per mole | – 25 |
| Diethanolamine | – 15 |

The composition is prepared preferably by adding the ethoxylated alcohol and diethanolamine to the water followed by the acid.

For washing and softening in laundering operations about ¼ cup of the foregoing is added to 20 gallons of water.

What is claimed is:

1. A composition consisting of:

| Ingredient | Parts by Weight |
|---|---|
| Water | – 29 |
| Disodium salt of 8-(4-hexyl-5-carboxycyclohex-2,3-en-1-yl)octanoic acid | – 31 |
| Linear primary $C_{12}$–$C_{15}$ alcohol ethoxylate containing about nine ethylene oxide units per mole | – 25 |
| Diethanolamine | – 15. |

* * * * *